US007946302B2

(12) United States Patent
Wallace et al.

(10) Patent No.: US 7,946,302 B2
(45) Date of Patent: May 24, 2011

(54) PARTS IMMERSION APPARATUS AND METHOD

(75) Inventors: Gregory M. Wallace, Evansville, IN (US); Timothy L. Schultz, Elberfeld, IN (US); James M. Gleason, Newburg, IN (US); David W. Carl, Wadesville, IN (US)

(73) Assignee: George Koch Sons LLC, Evansville, IN (US)

( * ) Notice: Subject to any disclaimer, the term of this patent is extended or adjusted under 35 U.S.C. 154(b) by 427 days.

(21) Appl. No.: 11/627,391

(22) Filed: Jan. 26, 2007

(65) Prior Publication Data

US 2007/0181169 A1 Aug. 9, 2007

Related U.S. Application Data

(60) Provisional application No. 60/764,901, filed on Feb. 3, 2006, provisional application No. 60/816,545, filed on Jun. 26, 2006.

(51) Int. Cl.
*B08B 3/04* (2006.01)

(52) U.S. Cl. ..... 134/124; 134/94.1; 134/95.2; 134/131

(58) Field of Classification Search ..... None
See application file for complete search history.

(56) References Cited

U.S. PATENT DOCUMENTS

| | | | | |
|---|---|---|---|---|
| 171,688 | A | 1/1876 | Morewood et al. | |
| 915,898 | A | 3/1909 | Sochurek, Sr. | |
| 2,128,028 | A * | 8/1938 | Hampton | 118/423 |
| 2,198,412 | A | 4/1940 | McDonald | |
| 2,570,021 | A | 10/1951 | Beach | |
| 2,673,835 | A | 3/1954 | Kearney | |
| 3,578,002 | A | 5/1971 | Rowan et al. | |
| 3,606,896 | A | 9/1971 | Holm | |
| 3,624,750 | A | 11/1971 | Peterson | |
| 3,693,951 | A * | 9/1972 | Lawhon et al. | 134/19 |
| 3,744,402 | A | 7/1973 | Piegza et al. | |
| 3,824,954 | A | 7/1974 | Hyosaka et al. | |
| 3,853,622 | A | 12/1974 | Rutten | |
| 3,935,719 | A | 2/1976 | Henderson | |
| 4,000,807 | A | 1/1977 | Molique | |
| 4,170,488 | A | 10/1979 | Norman | |
| 4,204,498 | A | 5/1980 | Ivancic | |
| 4,251,895 | A * | 2/1981 | Caridis et al. | 15/3.13 |
| 4,317,845 | A | 3/1982 | Karasawa et al. | |
| 4,344,448 | A * | 8/1982 | Potts | 134/73 |
| 4,353,381 | A | 10/1982 | Winters | |

(Continued)

*Primary Examiner* — Michael Kornakov
*Assistant Examiner* — Ryan Coleman
(74) *Attorney, Agent, or Firm* — Barnes & Thornburg LLP

(57) ABSTRACT

A parts immersion system and method includes a trough through which a conveyor belt carries the parts. A chemical solution is introduced into the trough through an opening in the bottom of the trough, from above the trough, and/or from the sides of the trough. The parts on the conveyor belt in the trough have a tendency to retard liquid movement out of the open ends of the trough thereby allowing the chemical solution to accumulate in the trough resulting in a greater immersion of the parts in the chemical solution. A gate may be provided near one or both ends of the trough to further enhance the accumulation of the chemical solution in the trough. Flights may extend upwardly from the conveyor belt to further enhance liquid retention in the trough between the flights. Flexible seals at the ends of the flights may contact sidewalls of the trough. One or more vibrators may be provided to enhance drainage of the chemical solution from the parts as the parts exit the trough.

14 Claims, 5 Drawing Sheets

U.S. PATENT DOCUMENTS 4,391,016 A 7/1983 Kawamura et al.
4,418,641 A 12/1983 Nakashima et al.
4,432,111 A 2/1984 Hoffmann et al.
4,465,014 A 8/1984 Bajka et al.
4,565,583 A 1/1986 Venetta
4,663,197 A 5/1987 Bok
4,794,018 A 12/1988 Scheetz
4,962,776 A 10/1990 Liu et al.
5,020,779 A 6/1991 Lindblom et al.
5,045,120 A * 9/1991 Mittag et al. ..... 134/26
5,052,332 A 10/1991 Hajek et al.
5,113,882 A 5/1992 Gileta
5,131,835 A * 7/1992 Rini et al. ..... 426/509
5,580,394 A 12/1996 Freytag
5,621,939 A * 4/1997 Yoshida et al. ..... 15/77
5,676,755 A 10/1997 Siemers et al.
5,921,278 A 7/1999 Wallace et al.
6,194,015 B1 * 2/2001 Garrett ..... 426/392
6,296,000 B1 10/2001 McTighe et al.
6,308,719 B1 10/2001 McTighe et al.
6,899,919 B2 5/2005 Chen
2003/0229957 A1 * 12/2003 Skinner et al. ..... 15/84

* cited by examiner

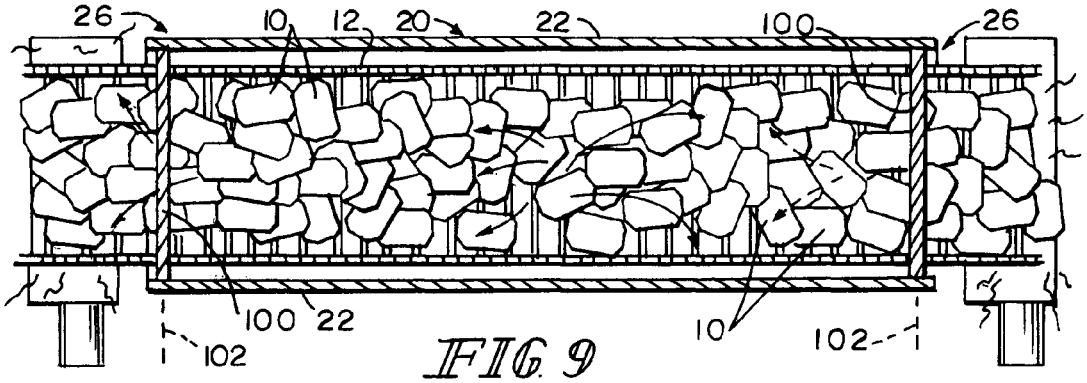
FIG. 9
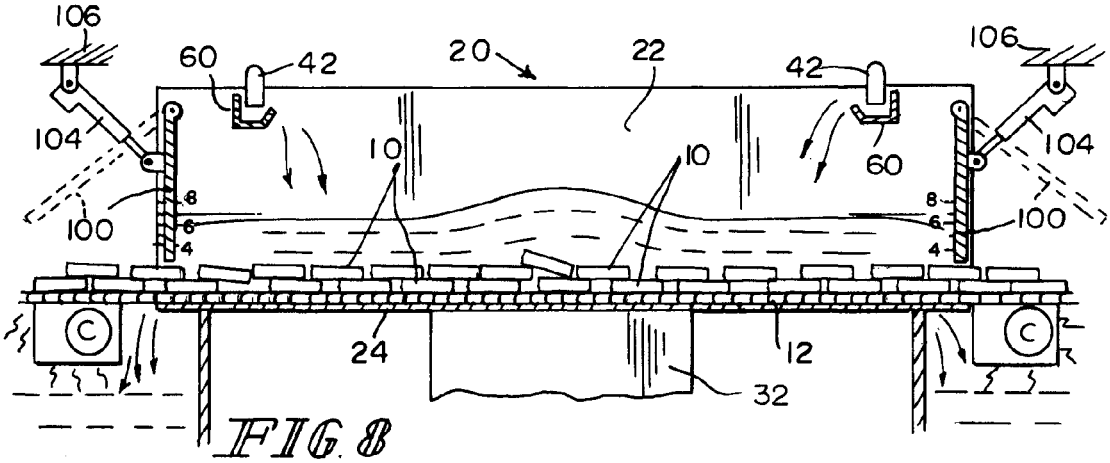
FIG. 8
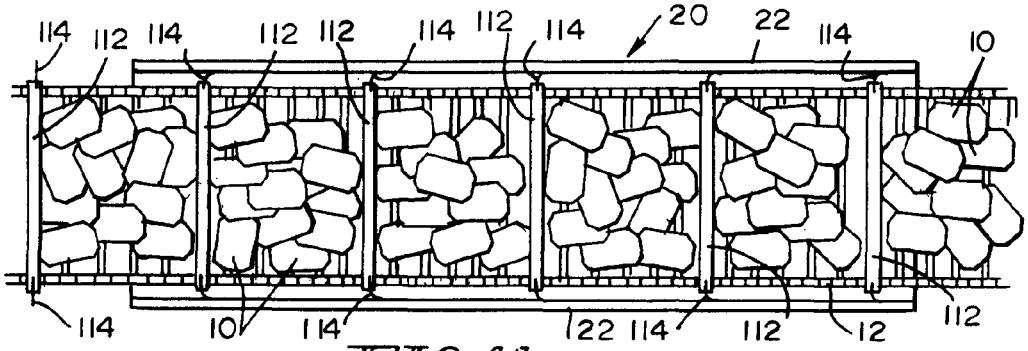
FIG. 11
FIG. 10
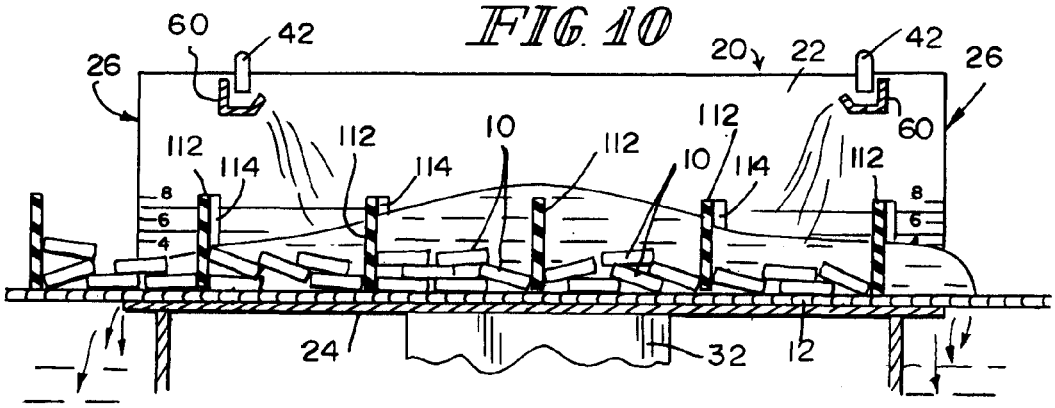

PARTS IMMERSION APPARATUS AND METHOD

This application claims the benefit, under 35 U.S.C. §119 (e), of U.S. Provisional Patent Application No. 60/764,901 which was filed Feb. 3, 2006 and which is hereby expressly incorporated by reference herein and this application also claims the benefit, under 35 U.S.C. §119(e), of U.S. Provisional Patent Application No. 60/816,545 which was filed Jun. 26, 2006 and which is hereby expressly incorporated by reference herein.

BACKGROUND OF THE INVENTION

The present disclosure relates to manufacturing processes for washing or coating parts. More particularly, the present disclosure relates to washing or coating parts by immersing the parts in a chemical solution.

In the field of parts finishing, it is typical for parts to go through one or more processes in which chemical solutions are applied to the parts. These processes may include, but are not limited to, the following: cleaning with caustic solution, acid pickling, conversion coating (such as with zinc phosphate or iron phosphate), sealing, rinsing, painting, plating, electrocoating, autophoretic coating, rinsing after painting, etc. It is very common for these processes to including placing parts into contact with chemical solutions. Often these solutions are aqueous liquids.

There are a variety of means of conveying parts through finishing processes. Parts may be hung on racks, and the racks moved through the processes by an overhead monorail conveyor or other similar means. Alternatively, racks may be moved by an indexing conveyor or hoist system. Other systems avoid racks and place parts loosely into containers, and move the containers via monorail or hoist. Another method is to place parts directly onto a belt conveyor.

Racking of parts is labor intensive. Placing parts in containers reduces labor, but still requires efforts to load and unload containers. Also, loading and unloading of containers automatically requires a certain level of sophistication in the equipment. Placing parts on a conveyor belt is often the alternative that requires the least labor, particularly if parts can be loaded automatically with vibratory feed equipment or other similar means.

Parts automatically loaded onto a conveyor belt may be loaded in a manner such that parts are not in contact with each other, or alternately they can be loaded such that parts are piled on the conveyor belt with many parts being in contact with other parts. For a given process length, loading piled parts allows processing of greatly increased quantities while providing parts with the same dwell time in the process. A disadvantage is that parts restrict the ability to deliver chemical solutions to other parts which are located nearer to the middle of the pile. Also, part-to-part contact may result in touch points which are never exposed to solutions, unless the pile is reoriented or adequately agitated to cause the parts to reorient relative to each other.

Parts may be exposed to chemical solutions in a number of ways, including being sprayed or being immersed in chemical solutions or both. The spray may take many different forms, including but not limited to an atomized mist, droplets, a curtain, or a jet. There are distinct advantages and disadvantages to spray application and immersion application. Spraying provides scrubbing action of the solution on the surface of parts. However, recessed areas on parts may receive reduce exposure to the spray. Also, if parts are conveyed in a manner such that some parts block delivery of chemical solutions to other parts, spray methods may not be suitable or at least are less desirable than immersion. Immersion typically gives complete part coverage, even through piled parts. However, immersion may not be as effective as spray at providing liquid movement over the parts. This is particularly true when parts are piled.

It can be seen that, if high volume, low cost finishing is desired, it might be desirable to have a process in which parts are automatically loaded onto a conveyor belt in a piled manner and then moved through an immersion process which produces strong fluid movement through the pile of parts. However, moving loosely piled parts on a conveyor belt through multiple immersions presents several difficulties which are not believed to have been adequately addressed in known immersion systems. A conveyor belt will naturally tend to travel in a straight line between points of support due to the tension in the belt which causes it to move. This path is affected by gravity acting on the conveyor belt, and the manner in which the belt is supported. For a conveyor belt to change direction from a general horizontal direction to a descent into a finishing solution, force would typically need to be applied to the top of the conveyor to overcome the tension in the conveyor belt. Means that apply force to the top of the conveyor belt in the middle of the belt are problematic due to interference with parts being conveyed. Therefore, it has been the normal practice to use conveyor belts which have substantial rigidity in a direction perpendicular to their travel, and to exert downward force on the outer edges of the conveyor belt beyond the portion of the belt that carries parts. Such a conveyor belt is generally more expensive and complex than a belt which does not require lateral rigidity.

Belts which do not possess substantial lateral rigidity may readily be made to change direction as they pass over supports, but any reversal of curvature typically requires applying force to both surfaces of the belt over the width of the belt. Reversed curvature of a belt may be achieved by allowing the belt to sag under the influence of gravity in an unsupported segment of the belt between supports. This is referred to as a catenary, or catenary sag.

Machines that include multiple descents and ascents of the conveyor belt are generally more complex and expensive than machines which move parts in a monotonic path, or a path that does not include reversals of belt curvature. Finally, parts subject to steep ascents or descents may cascade or tumble, which can be detrimental to their uniform conveyance. Flights on the conveyor belt can restrict part movement, but add complexity and interfere with automatic loading.

While disadvantages regarding various prior art systems have been discussed above, there is no intention to exclude or disclaim such systems, or portions or features thereof, from being within the scope of the appended claims. In fact, many features discussed above may be present in a parts immersion apparatus or method as contemplated and as claimed herein.

SUMMARY OF THE INVENTION

The present invention may comprise an apparatus or method that has one or more of the features listed in the appended claims, or one or more of the following features or combinations thereof, which alone or in any combination may comprise patentable subject matter:

An apparatus for applying a chemical solution to parts on a conveyor belt may include a trough through which the conveyor belt is routed. The trough may have at least three sides and the liquid solution may be introduced into the trough from above and/or from below. An open end, or open ends, of the trough may allow the chemical solution to be discharged from the trough under the influence of gravity. The tendency of the parts to retard liquid movement of the chemical solution may result in a greater immersion of the parts in the chemical solution.

The parts may be processed continuously or in batches. The solution leaving the trough may be directed to a different process after exiting the trough. The solution leaving the trough may be collected in a reservoir, such as a collector tank and/or accumulator tank, for re-use. The reservoir may be located directly under the trough or remote from the trough.

The parts may be conveyed either in contact with each other or not in contact with each other. The parts may be loaded onto the conveyor by manual means, automatic means, semi-automatic means, or any combination thereof. The parts may be randomly placed on the conveyor belt or may be selectively placed on the conveyor belt, optionally with means of securing them or limiting their movement. Optionally, the conveyor belt may possess significant lateral rigidity.

The vertical height of side walls of the trough, between which the one or more open ends of the trough are defined, may be greater than the horizontal lateral width of a bottom wall of the trough. End walls having a shorter vertical height than the side walls may be provided near the ends of the trough and the conveyor belt may descend into the trough and/or may ascend out of the trough in order to achieve a greater depth of immersion of the parts in the chemical solution in the trough.

The introduction of liquid into the trough and the action of gravity on the liquid may create substantial movement of the liquid over parts on the conveyor belt as the liquid moves toward one or both of the open ends of the trough. The liquid may be introduced into the bottom, sides, or top of the trough at a controlled rate. The rate may be controlled manually or automatically or combinations thereof. For example, the rate that liquid is introduced into the top of the trough may be controlled manually and the rate at which liquid is introduced into the bottom of the trough may be controlled automatically.

The liquid may be introduced into the trough through pipes, overflowing weirs, spray nozzles, or similar means. The liquid may be introduced into the through an opening in a bottom wall of the trough. The liquid may be introduced into a trough at a singular location or at multiple locations. The discharge velocity and volume may be independently controlled at any or all points of liquid introduction. The liquid may be introduced through an adjustable orifice or orifices such that the velocity and direction of the liquid entering the trough may be controllable independently of the total volumetric flow rate. The liquid chemical solution may drain from the trough at points in addition to the open ends of the trough.

The introduction of liquid into the trough may cause movement of the parts, and consequently, may improve the quality of the parts which exit the process. The liquid may be introduced in a direction and at a velocity such that the movement of liquid toward the ends of the trough may be further inhibited and the resulting immersion of parts in the trough may be increased. The liquid may be introduced into the trough from the top near the ends (in addition to other points of introduction) such that parts on the conveyor are exposed to finishing solutions on their top more quickly after entering the trough than they would be without introduction of the solutions from the top. The solution may return to a collection tank by moving down sloped walls or pans to eliminate free fall of liquid which may reduce foam generation.

The trough or its bottom wall may be sloped in the direction of conveyor travel in order to achieve concurrent movement of parts and solution for circumstances in which concurrent movement of parts and solution is desired. The liquid may be introduced into the trough with a direction and velocity in the direction of conveyor travel in order to achieve concurrent movement of parts and solution for circumstances in which concurrent movement of parts and solution is desired. The trough or its bottom wall may be sloped opposite the direction of conveyor travel in order to achieve countercurrent movement of parts and solution for circumstances in which countercurrent movement of parts and solution is desired. The liquid may be introduced into the trough with a direction and velocity opposite the direction of conveyor travel in order to achieve countercurrent movement of parts and solution for circumstances in which countercurrent movement of parts and solution is desired.

Air may be discharged near the trough and may have a directional component which may impede the flow of liquid out of the trough, consequently increasing the immersion of parts. The discharged air may comprise an air curtain. Two air curtains, one near each end of the trough may be provided. The conveyor belt may descend into the trough and/or ascend out of the trough due to catenary sag of the belt between supports. A portion of the sagging conveyor belt may contact and be supported by the bottom of the trough.

A movable gate may be provided near one or both ends of the trough. The gate may have a closed position to retard the chemical solution from exiting the trough so as to increase the amount of chemical solution retained in the trough near the gate. The gate may have an opened position moved away from the closed position. An actuator may be provided for moving the gate between the opened and closed positions. The gate may be coupled to sidewalls of the trough at an upper end thereof for pivoting movement about a generally horizontal axis.

A vibrator may be coupled to the trough and operable to vibrate the trough to enhance drainage of the chemical solution from the parts as the parts exit from the trough. If first and second spaced apart troughs are provided in a manufacturing process, then the vibrator may be coupled to a connecting wall that may span the gap between the troughs and that may be coupled to side walls of the troughs. In such an arrangement, the vibrator may be operable to vibrate both troughs. The vibrator may comprise a motor with a rotating eccentric or other imbalance to produce vibrations.

Flights that extend upwardly from the conveyor belt may be provided, if desired. The flights may be configured to retard liquid movement out of the trough. Seals may be coupled to ends of the flights and may be configured to contact sidewalls of the trough as the flights move through the trough. The seals may extend substantially from top to bottom along the ends of the flights such that the flights, seals, sidewalls of the trough, and the conveyor belt may cooperate to provide a series of moving open top containers in which the chemical solution may generally be retained.

The parts to be conveyed through the trough and treated by the chemical solution may be made of any type of material. For example, the parts to be conveyed through the trough and treated by the chemical solution may comprise metal parts, a bed of wood strands, wood pieces, scrimber, or other porous media. The chemical solutions may comprise preservatives, sealants, or resins, just to name a few. However, chemical solutions of any type are contemplated by this disclosure. The parts to be immersed in the chemical solution may be buoyant and a restraining mechanism may be provided above the conveyor belt and above the buoyant parts to prevent the buoyant materials from floating on top of the chemical solution in the trough. The restraining mechanism may comprise a top conveyor belt, a series of rollers, or at least one hold down shoe.

Additional features, which alone or in combination with any other feature(s), such as those listed above and those listed in the appended claims, may comprise patentable subject matter and will become apparent to those skilled in the art upon consideration of the following detailed description of illustrative embodiments exemplifying the best mode of carrying out the embodiments as presently perceived.

BRIEF DESCRIPTION OF THE DRAWINGS

The detailed description particularly refers to the accompanying figures in which:

FIG. 8 is a sectional view showing gates at the ends of the trough, a set of actuators coupled to the gates, and the actuators being operable to move the gates from respective closed positions (in solid) enhancing the retention of chemical solution in the trough and opened positions (in phantom) away from the closed positions;

FIG. 9 is a top plan view showing the gates extending from one side wall of the trough to the other;

FIG. 10 is a sectional view showing a series of spaced apart flights coupled to the conveyor belt and extending upwardly therefrom;

FIG. 11 is a top plan view showing flexible seals at the ends of the flights contacting the side walls of the trough;

DETAILED DESCRIPTION OF THE DRAWINGS

Figure 1:
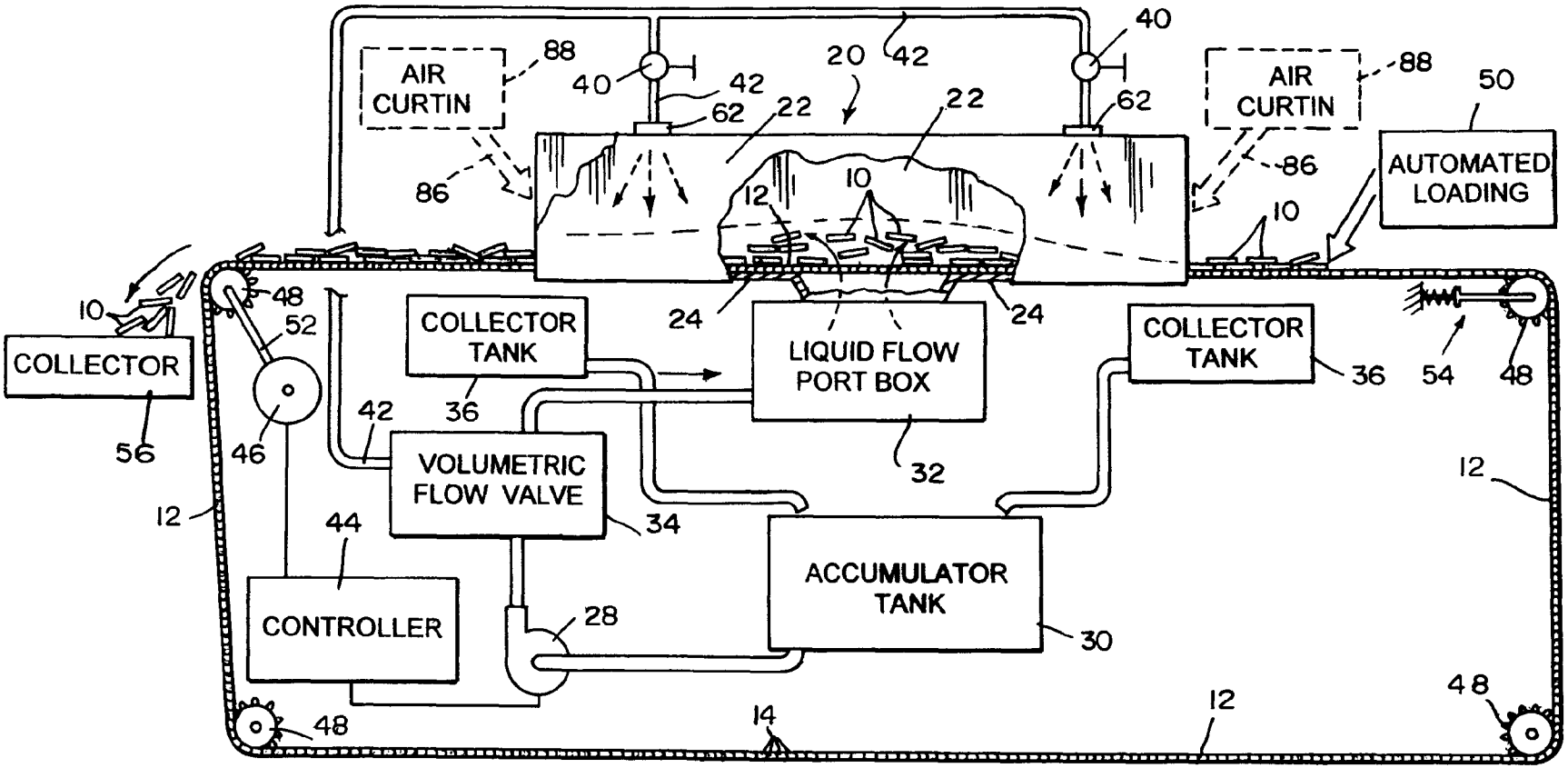
FIG. 1 is a diagrammatic view of a parts immersion apparatus in accordance with this disclosure showing a trough, a conveyor belt routed through the trough and carrying parts that are stacked on each other in a random manner, a liquid flow port box which is situated beneath the trough and which directs liquid upwardly into a central region of the trough, the liquid flowing over the parts on the conveyor belt and exiting open ends of the trough for collection by a pair of collector tanks, the collector tanks coupled to an accumulator tank, and a pump which pumps liquid from the accumulator tank to the liquid flow port box.

According to this disclosure, parts 10 on a conveyor belt 12 are conveyed through a trough 20 during a manufacturing process, such as a finishing process, as shown diagrammatically in FIG. 1. A chemical solution is presented to the parts 10 in such a manner that the parts 10 are effectively immersed while in the trough 20, and vigorous but controllable liquid movement takes place in the finishing solution. The chemical solution introduced into the trough 20 may be any desired liquid solution such as a solution used for cleaning, acid pickling, conversion coating (such as zinc phosphate or iron phosphate), sealing, rinsing, painting, plating, electrocoating, autophoretic coating, and rinsing after painting, just to name a few. Although FIG. 1 illustrates a single stage of an overall manufacturing process, several stages in which parts 10 are conveyed through troughs 20 are contemplated by this disclosure, with parts 10 being immersed in different solutions at each stage.

Figure 2:
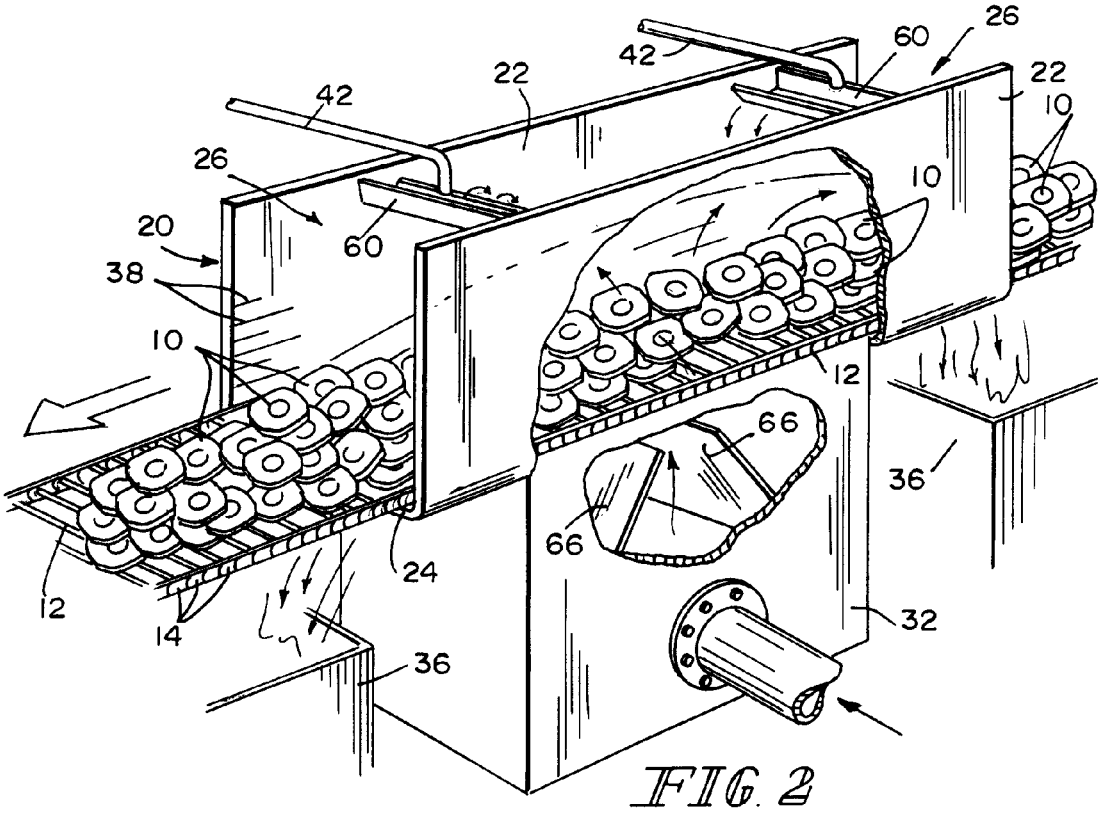
FIG. 2 is a perspective view of the trough, the liquid flow port box, portions of the collector tanks, and portions of the conveyor belt, showing the trough having spaced vertical side walls, the conveyor moving parts through the trough between the side walls and above a bottom wall of the trough, liquid being pumped upwardly into the trough through the liquid flow port box, the trough having a pair laterally extending channel members interconnecting the side walls of the trough, liquid being directed into respective channel members by respective liquid delivery pipes, the liquid filling the channel members and overflowing downwardly into the trough, and the liquid flowing out of the open ends of the trough into the collector tanks.

In the illustrative example, trough 20 is a three-sided trough having a pair of generally vertical side walls 22 and a bottom wall 24 extending between bottom regions of walls 22 as shown in FIGS. 1 and 2. Thus, trough 20 has open ends 26 as shown best in FIG. 2. Conveyor belt 12 passes from one open end 26 of the trough 20 to the other. The trough 20 is sized such that side walls 22 are situated just outboard of conveyor belts 12 with only a minimal amount of clearance therebetween. In addition, conveyor belt 12 is situated within trough 20 in close proximity to, or even in contact with, bottom wall 24.

When liquid (such as any of the chemical solutions listed above) is introduced into trough 20, the parts 10 on the portion of conveyor belt 12 contained in the trough 20 retard the flow of the liquid to the open ends 26 of trough 20. This causes the liquid to accumulate sufficiently in the trough 20 to partially or fully submerge or immerse the parts 10. This accumulation of liquid in trough 20 can be achieved at liquid delivery rates that are easily achievable by commercially available pumps. In the illustrative example, a pump 28 is operable to pump liquid from an accumulator tank 30 through a liquid flow port box 32 and into trough 20 through an opening in bottom wall 24 of trough 20 as shown diagrammatically in FIG. 1. Optionally, a volumetric flow valve 34 is provided to adjust the volume flow rate of liquid pumped from pump 28 to box 32.

Additionally or alternatively, the speed of pump 28 may be varied to change the volume flow rate of the liquid pumped to box 32.

The movement of the liquid toward the open ends 26 of the trough 20 causes dynamic liquid movement over surfaces of the parts 10. The liquid delivery can be adjusted such that it is not so forceful as to impede conveyance of the parts 10 or dislodge the parts 10 from the conveyor belt. However, the volume and/or velocity and/or directionality of liquid delivery may be sufficient to jostle the parts 10 or reorient the parts 10 relative to each other so as to change the contact points between the parts 10 to enhance the immersion of the parts 10 by ensuring that substantially all portions of each part 10 are exposed to the chemical solution.

At the ends 26 of the trough 20, liquid may be discharged for recollection and use in the same process or another process. More typically and as shown diagrammatically in FIG. 1, the liquid exiting the ends 26 of the trough 20 will return to a collector such as a basin or collection tank 36 from which the liquid will be recycled through the finishing machine. In some embodiments, the collection tank 36 is directly under the trough 20 and in close proximity to it. The collection tanks 36 are fastened to the trough 20 in some embodiments. However, a remote collection tank 36 may be used in certain circumstances, and is within the scope of the present disclosure.

Figure 3:
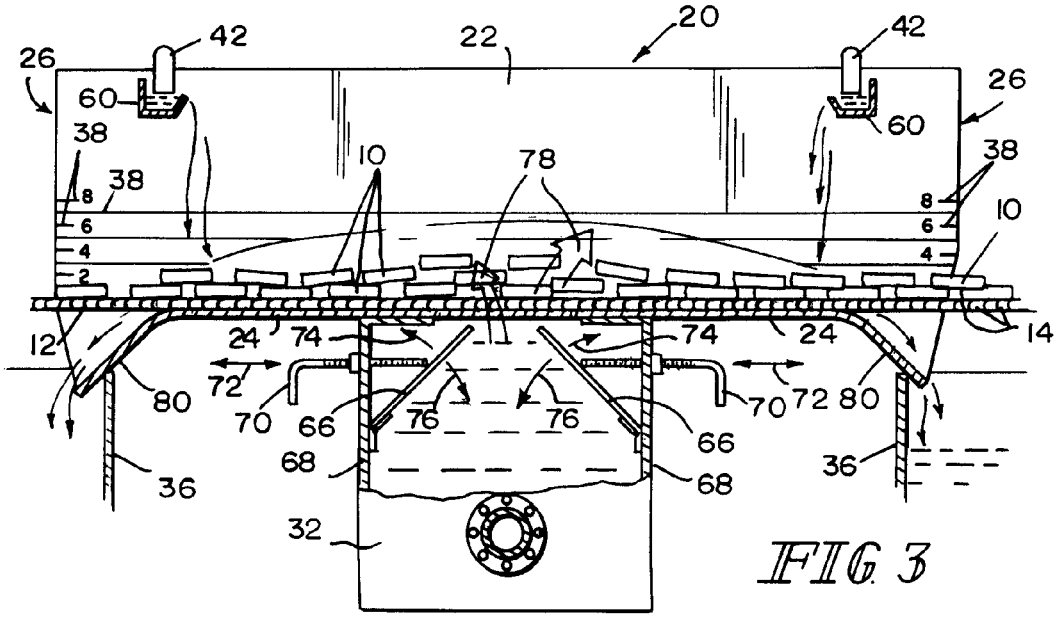
FIG. 3 is a cross sectional view showing the liquid flow port box having movable baffles which are moved to adjust the size of an outlet orifice from the liquid flow port box and showing an alternative embodiment of a trough having end regions of the bottom wall sloped downwardly to direct the liquid exiting the trough into the collector tanks.

Liquid may be introduced into the bottom, top, and/or sides of the trough 20. Pump 28 or other liquid delivery means delivers the solution to the trough 20 at a flow rate that achieves full or partial immersion parts 10 on the conveyor belt 12. Conveyor belt 12 is sometimes referred to herein as simply conveyor 12. The ideal or desired flow rate of solution may depend on the width of the trough 20, the weight of individual parts 10, the depth of the piled parts 10, and the amount of flow restriction that the piled parts 10 present. If desired, one or both of side walls 22 of trough 20 may have graduated markings 38 which enable an operator to quantify the height within the trough 20 at which the fluid accumulates. In the illustrative example, the graduated markings are spaced at 1 inch intervals up to 8 inches as shown in FIGS. 2 and 3.

In addition to the volumetric flow valve 34 and variable speed pump 28 mentioned above, other throttling devices may be employed in the system to control the fluid delivery rate. For example, a pair of manually adjustable valves 40 serves as throttling devices in piping 42 which delivers liquid into trough 20 from above and a variable frequency controller on the pump motor may serve as an additional throttling device. Structure in box 32 also serves as a throttling device as will be discussed in further detail below. In some embodiments, flow rate sensors may be provided at one or more points in the system and/or liquid sensors may be coupled to trough 20 to sense the height of the liquid accumulation in trough 20. Such sensors may provide signals to a controller 44 which, in turn, controls the operation of pump 28, valve 34 (and any other electrically controllable valves in the system), and/or a motor 46 which drives the speed at which conveyor 12 moves parts 10 through trough 20. Thus, control of liquid delivery to trough 20 may be via manual adjustment, automatic adjustment based on previous results for similar parts 10, or automatic adjustment using feedback type systems.

Conveyor 12 includes a number of interconnected links 14 which have suitably large spaces between portions of the links 14 to permit fluid flow through the conveyor 12. Thus, liquid introduced into trough 20 through the opening in bottom wall 24 is able to flow upwardly through the spaces in the conveyor 12 to reach the parts 10 carried by conveyor 12. The liquid is also able to drain downwardly through these spaces in conveyor 12 to reach the collection tanks 36 adjacent the ends of trough 20. In the diagrammatic example of FIG. 1, conveyor 12 forms a continuous loop that is supported by a set of sprockets 48, one of which is coupled to motor 46 by an axle 52 and another of which is coupled to a belt tensioning mechanism 54. All manners of driving, supporting, and tensioning conveyor belts are intended to be within the scope of this disclosure.

In some embodiments, an automated loading machine 50 deposits parts 10 on conveyor 12 as shown diagrammatically in FIG. 1, although manual loading of parts onto conveyor 12 is within the scope of this disclosure. After passing through trough 20 for immersion in the associated chemical solutions, the parts 10 are offloaded from the conveyor 12 onto another conveyor, onto some other piece of equipment, or into a collector 56 as shown diagrammatically in FIG. 1.

Various means of introduction of liquid into the trough 20 are within the scope of this disclosure, and include overflowing weirs 60 as shown in FIGS. 2 and 3, spray nozzles 62 as shown in FIG. 1, etc. In the illustrative embodiment, overflowing weirs 60 comprise channel members that span laterally across trough 20 from one of side walls 22 to the other 22 near the top edges thereof. Liquid exiting piping 42 fills the weirs and overflows downwardly onto the parts 10 therebelow. Alternatively or additionally, one or more longitudinally extending weirs and/or spray nozzles spaced longitudinally along trough 20 may be provided to achieve the immersion of parts 10 in trough 20. Thus, parts 10 are immersed in trough 20 according to this disclosure regardless of whether liquid is introduced into the bottom, top, or sides of the trough or any combination thereof.

In the illustrative embodiments, a fairly significant volume of liquid is introduced into the trough through an adjustable orifice included in liquid flow port box 32. This creates an adjustable jet of liquid, which injects the solution into the spaces between the piled parts 10. In the illustrative example, the adjustable orifice allows the direction and amount of force of the jet to be adjusted without adjusting the volumetric flow rate of the solution. The jet may be adjusted such that parts are shifted or slightly reoriented, but this need not be the case. If the parts are shifted, this addresses the problem of touch points between parts not being exposed to solutions but again, it is not required that the parts be shifted to expose touch points according to this disclosure. In the illustrative embodiment, the adjustable orifice comprises a pair of baffles or panels 66 which are hinged to opposite walls 68 of box 32 as shown in FIGS. 2 and 3.

In the illustrative example, manual adjusters 70 in the from of threaded rods are threaded through walls 68 and/or through threaded members 69 provided on walls 68 and are rotated to move inwardly and outwardly relative to walls 68 as indicated by double-headed arrows 72 in FIG. 3. The ends of adjusters 70 are coupled to baffles 66 such that rotation of adjusters 70 in one direction pivots baffles 66 in an upward direction, as indicated by arrows 74, to increase the orifice size and such that rotation of adjusters 70 in an opposite direction pivots baffles 66 in a downward direction, as indicated by arrows 76, to decrease the orifice size. Adjusters 70 are operable independently such that baffles 66 may be oriented at different angle relative to the respective walls 66 of box 32, thereby to change the directionality of the jet of liquid passing through the orifice as indicated by arrows 78 in FIG. 3. If desired, powered means of adjustment, such as motors and associated linkage system may be provided for adjusting the orientation of baffles 66 in lieu of manual adjusters 70.

Figure 6:
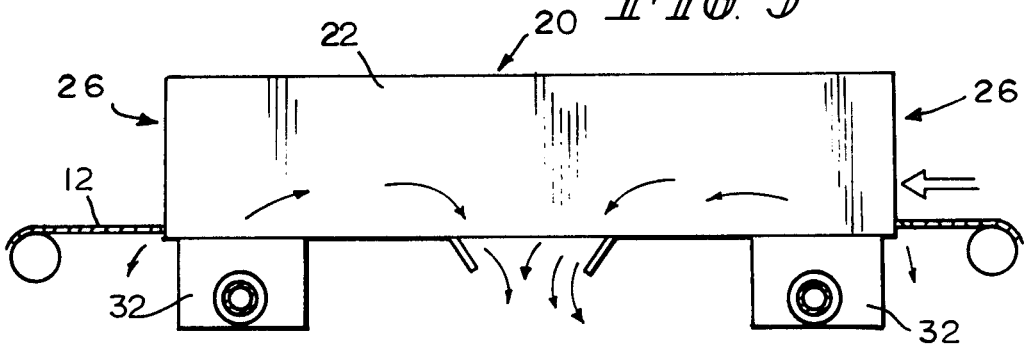
FIG. 6 is a diagrammatic view showing liquid being introduced near the ends of the trough and draining out of the trough at a central region thereof.

As shown in FIG. 6, another embodiment according to this disclosure is configured such that liquid is introduced through boxes 32 into trough 20 near the opposite ends 26 of the trough 20 and discharged from trough 20 through an opening in bottom wall in the middle region of the trough 20. The baffles 66 of boxes 32 in this embodiment are oriented such that the directional velocity component of the liquid introduced into trough 30 is toward the middle region of trough 20 so as to retard the flow of liquid out of the ends 26 of the trough, and contributes to increasing the depth of immersion achieved in the middle of the trough. In this embodiment a collection tank 36 is situated beneath the opening in the middle region of trough 20.

During testing of a prototype device according to the present disclosure, it has been observed that near the ends 26 of the trough 20, the liquid depth naturally diminishes as compared to the liquid depth in the middle of trough 20. In order to achieve substantially equal exposure times for parts 10 on the top of the pile compared to parts 10 on the bottom of the pile, liquid may be introduced from above. This may take the form of spray nozzles 62, a series of orifices, or one or more overflowing weirs or troughs 60 which produces a downward flowing curtain of solution. The introduction of solution from above is controlled independently from the other points of liquid introduction, which provides greater flexibility in adapting the process to various parts 10 and pile heights.

Some chemical solutions are susceptible to the generation of foam when they are moved in the presence of air. Thus, if trough 20 is to be used in conjunction with solutions that are prone to foaming, it is within the scope of this disclosure for measures to be taken to reduce foam creation via appropriate use of additional liquid-directing trays or via modifications to trough 20. In the illustrative example shown in FIG. 3, trough 20 is modified in the regions where the liquid leaves the ends 26 of the trough 20 to be returned to collection tanks 36 for recirculation. Specifically, each end of bottom wall 24 has a downwardly curved or inclined portion 80 so that the liquid travels along an inclined or curved path into the respective collection tank 36 such that liquid does not free fall, if the inclined portion 80 terminates beneath the upper surface of the liquid in the associated collection tank 36, or free falls by a lesser amount than if inclined portion 80 were not provided. This reduces turbulence and the consequent build up of foam. It is contemplated therefore, that the lower ends of portions 80 of bottom wall 24 of trough 20 may be positioned below the upper surface of the liquid that has accumulated in collection tanks 36.

Figure 4:
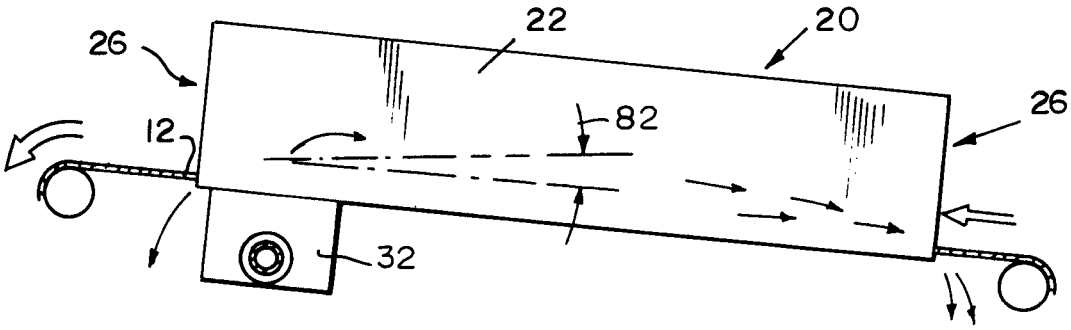
FIG. 4 is a diagrammatic view showing the liquid being introduced near a raised end of an inclined trough, the liquid primarily moving downwardly through the trough under the influence of gravity, and the conveyor belt carrying the parts at an upward incline through the trough such that the parts move against the primary flow of the liquid in a countercurrent arrangement.

During some pretreatment processes or other processes, it is sometimes desirable for solution movement to be countercurrent to the movement of parts 10. In this way, the cleanest parts 10 are exposed to fresh solution, and the contaminants removed from parts 10 are moved downstream towards the more contaminated parts 10, not less contaminated parts 10. According to this disclosure, therefore, trough 20 as a whole, or bottom wall 24 of trough 20 itself, may be inclined at an angle 82 relative to horizontal and the portion of the conveyor 12 within trough 20 may be inclined at a substantially similar angle, with the conveyor being operated to move the parts up the incline as shown in FIG. 4. Furthermore, the objective of exposing the cleanest parts 10 to the freshest solution as the parts 10 move through trough 20 is furthered by having the preponderance of solution introduced near the parts discharge end 26 of the trough 20 as also shown in FIG. 4. In this arrangement, gravity causes the desired countercurrent flow of solution down the incline of the bottom wall of trough 20 as the parts 10 are moved by conveyor 12 up the incline. Countercurrent movement of liquid may also be achieved in a horizontal trough 20 in which the liquid is introduced with a velocity and direction that is opposite the direction of travel of the conveyor 12 and parts 10 such that countercurrent movement of parts 10 and solution is achieved.

Figure 5:
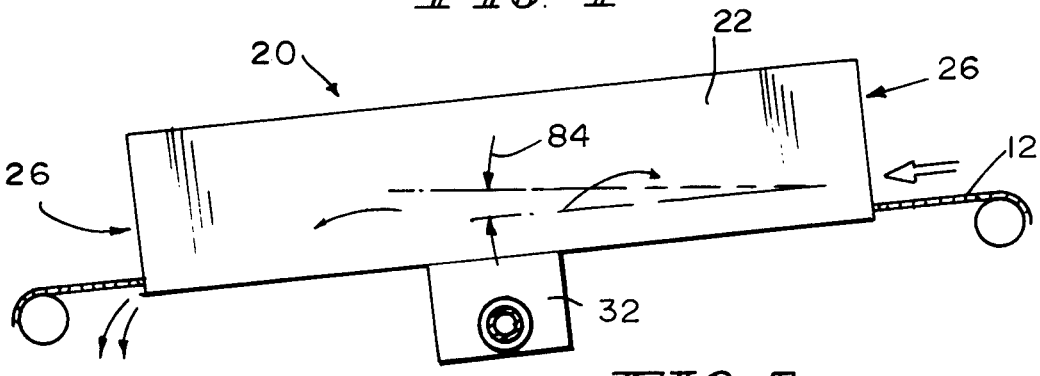
FIG. 5 is a diagrammatic view showing liquid being introduced near a central region of an inclined trough, the liquid primarily moving downwardly through the trough under the influence of gravity, and the conveyor belt carrying the parts at a downward incline though the trough such that the parts move with the primary flow of the liquid in a concurrent arrangement.

While less common, it may be desirable for solution movement to be concurrent to part movement as shown in FIG. 5. For these circumstances, trough 20 as a whole, or bottom wall 24 of trough 20 itself, may be inclined at an angle 84 relative to horizontal and the portion of the conveyor 12 within trough 20 may be inclined at a substantially similar angle, with the conveyor being operated to move the parts down the incline as shown in FIG. 4. In this arrangement, therefore, liquid may be introduced with a velocity and direction such that concurrent movement of parts and solution is achieved. Of course, gravity also influences the liquid to flow down the incline of bottom wall 24 of trough in the same direction as part movement. Although box 32 is located in the middle region of trough 20 in the illustrative example of FIG. 5, it is within the scope of this disclosure for box 32 to be located near the raised end 26 of trough 20.

It is generally desired for excess solution to drain off of parts 10 prior to their entry into subsequent process stages but this need not be the case. In order to assist gravity drainage of solution, air may be blown on the parts between stages. For example, an air curtain generator 88, shown in phantom in FIG. 1, may be provided near each end 26 of trough 20 to direct an air current downwardly over the parts 10 to enhance fluid drainage. Similar to the idea of discharging solution with a velocity component toward the mid-length of the trough, air blown between stages may be discharged with a directional component that assists in the accumulation of solution in the trough as indicated by phantom arrows 86 shown in FIG. 1.

Figure 7:
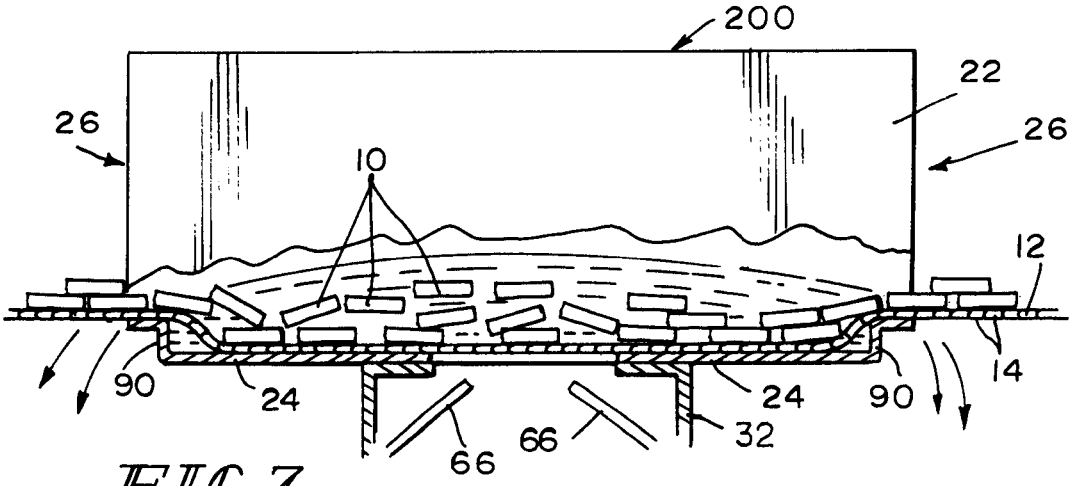
FIG. 7 is a cross sectional view showing the trough having short end walls near the ends of the trough and the conveyor belt sagging downwardly relative to the end walls so as to descend into the trough and ascend out of the trough thereby achieving a greater depth of immersion of the parts in the chemical solution in the trough.

In addition to the simple three-sided trough 20 of FIGS. 1-6, this disclosure contemplates another embodiment of a trough 200 which has short dams or end walls 90 on the otherwise open ends 26 of the trough 200. Trough 200 is similar to trough 20 in many respects and therefore, like reference numerals are used to denote portions of trough 200 that are substantially similar to like portions of trough 20. The conveyor belt 12 passes over the dam 90 at the entrance end 26 of the trough 200, and descends below the liquid level in the trough 200 due to the influence of gravity on the conveyor 12 and the parts 10 carried thereby. At the exit end 26 of the trough 200, the conveyor belt 12 ascends over the short dam 90. Therefore, a greater submergence of parts 10 in the liquid is achieved in the embodiment of FIG. 7. In the illustrative example, the vertical movement of the conveyor 12 downwardly into the space between walls 90 is assisted by gravity and conveyor belt tension, and the conveyor belt 12 is not vertically constrained during its ascent or descent in this example. In this manner, the conveyor belt 12 may optionally be of a simple construction which does not require substantial lateral rigidity.

Optionally, additional mechanisms may be used in conjunction with trough 20 or trough 200 to enhance the accumulation of chemical solution in trough 20, 200 thereby to provide enhanced immersion of the parts 10 while the parts 10 are within trough 20, 200. Examples of these additional mechanisms are shown in FIGS. 8-11 as being used with trough 20. However, it is within the scope of this disclosure for these additional mechanisms to be used with trough 200 or with any of the other trough embodiments disclosed herein. Use of such mechanisms to enhance accumulation of the chemical solution in trough 20, 200 serves to alleviate concerns, in some instances, that the leading edge of a long stream of parts (or the trailing edge of a long stream of parts)

may not receive equivalent immersion time compared to the remainder of the pile due to the absence of a pile of parts 10 in front of the leading edge or behind the trailing edge which results in the solution flowing out of the open end of the trough more readily because less parts are present in the trough 20, 200 to impede the flow.

Referring to FIGS. 8 and 9, a gate 100 is provided near each end 26 of trough 20. In other embodiments, only one gate 100 is provided, typically near the exit end 26 of trough 20, although this need not be the case. The gate 100 near the entrance end 26 of trough 20 is sometimes referred to herein as the "infeed gate 100" and the gate 100 near the exit end 26 of trough 20 is sometimes referred to herein as the "outfeed gate 100." In the illustrative example, gates 100 are coupled at their top regions to the side walls 22 of trough 20 for pivoting movement about respective pivot axes 102. A respective actuator 104, such as a linear electric or hydraulic actuator, is coupled to each gate 100 and to another supporting structure 106 (shown diagrammatically in FIG. 8). Other types of actuators 100, such as pneumatic actuators, motors, stepper motors, as well as manual levers, hand cranks, and the like, either alone or in combination with linkages, transmissions, cables, pulleys, chains, sprockets and the like, are also contemplated by this disclosure for moving gates 100 between the opened and closed positions. The supporting structures 106 may be, for example, one or more frame members that are coupled to trough 20, one or more frame members of the structure that supports conveyor belt 12, one or more frame members of a free-standing framework, or even part of the building, such as a wall or ceiling, within which trough 20 is located.

Each actuator 104 is independently operable to move the respective gate 100 between an opened position (shown in phantom in FIG. 8) and a closed position (shown in solid in FIG. 8). The bottom edges of gates 100 are spaced from conveyor belt 12 when gates are in the closed positions, and therefore, gates 100 do not completely seal the ends 26 of trough 20. However, clearance between the bottom edges of gates 100 and conveyor belt 12 is sufficiently small that the solution in trough 20 is impeded, to some extent, from flowing out of the end 26 of trough 20 when the associated gate 100 is in the closed position. By impeding the flow of solution out of the ends 26 of trough 20 in this manner, the solution accumulates in trough 20 to a greater extent than when gates 100 are in the opened positions.

When the conveyor belt 12 or line is being initially charged or loaded with parts 10 upstream of the entrance end 26 of trough 20, the outfeed gate 100 is placed in the closed position and the infeed gate 100 is placed in the opened position. As parts 100 progress through the trough 20 on the conveyor belt 12, the outfeed gate 100 is moved from the closed position to the opened position as the parts approach the outfeed gate 100. As the trailing edge of the pile of parts 10 enters into the trough 20, the infeed gate 100 is moved to the closed position as the last parts 100 pass. By operating the gates 100 in this way, the immersion of the parts near the leading edge and trailing edge of the pile of parts 10 is enhanced. In some embodiments, optical sensors or other types of sensors are provided to signal a control system as to the height of the pile of parts 10 approaching gates 100 and the control system, in turn, operates actuators 100 to open and close gates 100 based on the signals from the sensors. In such an automatic control system, actuators 104 may be controlled to vary the position of gates to any number of intermediate positions between the opened and closed positions depending upon the height of the pile of parts in the vicinity of gates 100, the goal being to have the bottom edge of gates 100 spaced from the top of the pile of parts 10 by only a small amount to provide enhanced solution retention in trough 20.

Referring now to FIGS. 10 and 11, a plurality of flights 112 are coupled to conveyor belt 12 and extend upwardly therefrom. In the illustrative example, the spacing between flights 112 is uniform, however that need not be the case. While flights 112 may have any desired height, in some embodiments, the height of flights 112 is greater than the height of the pile of parts 10 to be contained between flights 112 on conveyor belt 12 but is less than the height of side walls 22 of trough 20. Of course, if there is structure in the interior of trough 20, such as overflowing weirs 60, then the height of flights 112 is such that the flights 112 can pass beneath such structures without interference. As solution is introduced into trough 20 from above and below, flights 112 impede the flow of the solution towards the ends 26 of trough 20 thereby enhancing the accumulation of solution in the spaces between flights 112.

Optionally, seals or wipers 114 are coupled to the ends of flights 112 and wipe against the side walls 22 of trough 20 as the flights 112 pass through trough 20 as shown best in FIG. 11. The lateral spacing between the opposite ends of flights 112 are less than the lateral spacing between side walls 22 of trough 20, but the lateral spacing from the outer edges of the wipers 114 coupled to any particular flight 112 is larger than the lateral spacing between side walls 22 of trough 20 when wipers 114 are in an unflexed state as shown in FIG. 11 with respect to the leftmost flight 112 in FIG. 11 which is situated outside trough 20. Flights 112 are made of a substantially rigid material, such as metal or high-strength plastic, whereas wipers 114 are made from a flexible material, such as rubber. Thus, as flights 112 enter the entrance end 26 of trough 22, wipers 114 flex due to contact with side walls 22 of trough 20 and remain biased against the side walls 22 of trough 20 as the flights 22 pass through trough 20. As two consecutive flights 112 pass through trough 20, the consecutive flights 112 and wipers 114 cooperate with side walls 22 of trough 20 and with conveyor belt 12 to define a moving, open-topped, rectangular volume. It will be appreciated that this volume is not liquid tight due to, for example, the large number of openings through conveyor belt 20 that allow the chemical solution to move upwardly from liquid port box 32 to reach parts 10. However, introducing solution into the volume from the top and/or the bottom sufficiently rapidly to completely fill the volume all the way to the top of the flight 112 with chemical solution, thereby providing a moving immersion chamber, is contemplated by this disclosure. Use of flights 112, and optionally, wipers 114, may be desirable for parts that do not provide sufficient resistance to flow, and cannot be effectively immersed without these additional structures.

Figures 12, 13:
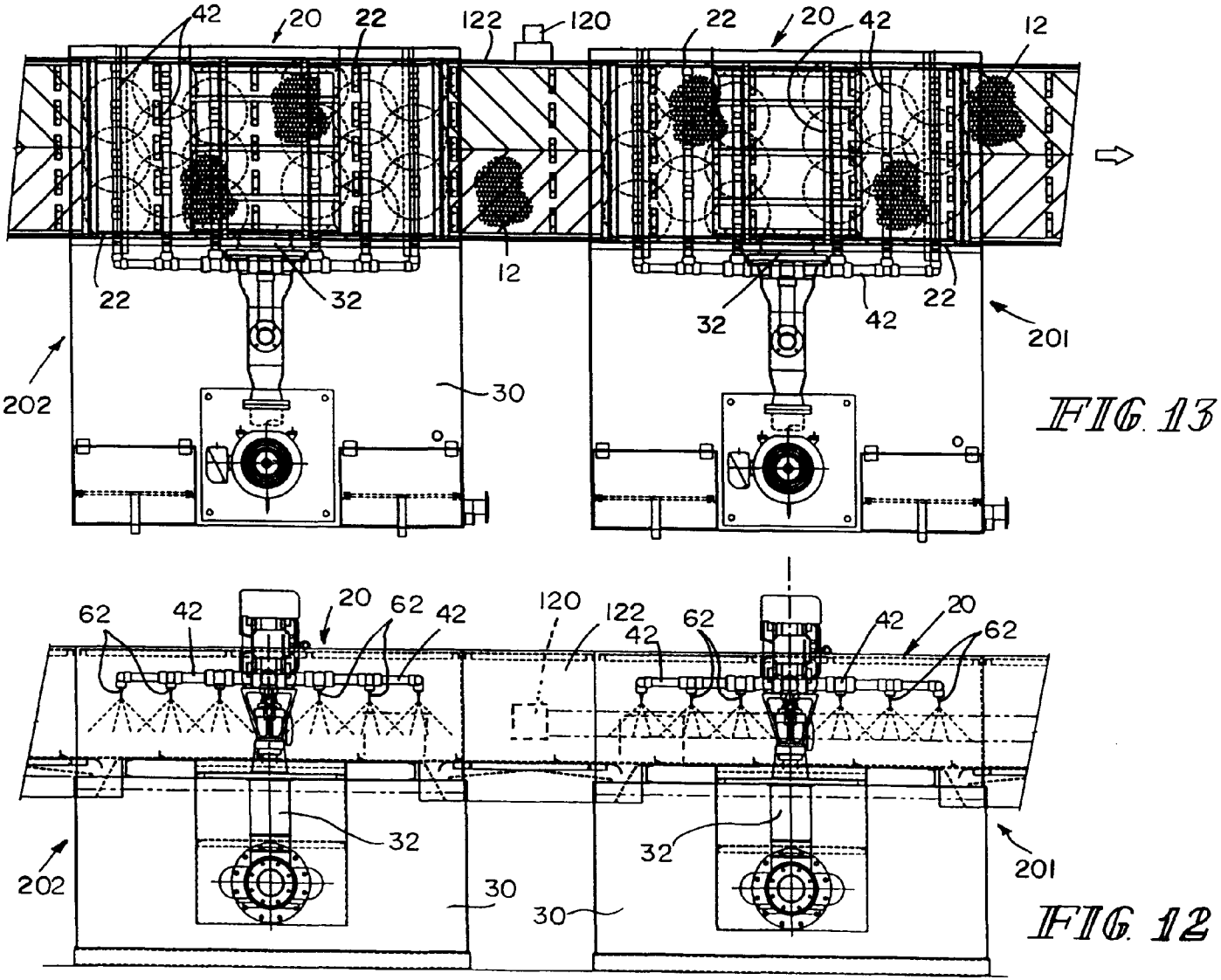
FIG. 12 is a sectional view showing first and second spaced apart troughs through which parts are conveyed on a single conveyor belt for immersion in respective first and second chemical solutions.
FIG. 13 is a top plan view showing a vibrator coupled to a wall that spans the gap between the first and second troughs.

Referring now to FIGS. 12 and 13, a tandem set of troughs 20 are provided in a first stage 201 and a second stage 202 of a manufacturing process. A plurality of spray nozzles 62 is coupled to associated piping 42 and the nozzles 62 are operable to spray chemical solution onto parts 10 from above as shown best in FIG. 12. A series of overlapping dotted circles in FIG. 13 indicate the general areas of coverage of the various nozzles 62. Rather than using an air blow-off to assist drainage of parts 10 exiting troughs 20 of stages 201, 202, a vibrator 120 is coupled to a generally vertical wall 122 that spans the gap between side walls 22 of respective troughs 20. The vibrator 120 comprises a motor with a rotating eccentric in some embodiments. The vibrations from vibrator 120 are communicated to troughs 20, conveyor belt 12, and the parts 10 carried by conveyor belt 12. The vibrations assist with drainage of the chemical solution from the parts 10 as the parts exit troughs 20. The amplitude of vibration of vibrator 120, the frequency of vibration of vibrator 120, or both is adjustable in order to optimize the drainage of solution from parts 10. If desired, an air blow-off such as via an air curtain generator 88 may also be used in conjunction with vibrator 120 to enhance liquid drainage from the parts 10.

As already mentioned, all sorts of different types of parts 10 may be conveyed through the troughs disclosed herein and all sorts of chemical solutions may be introduced into the troughs disclosed herein. For example, in the processing of wood, it is common for wood pieces to be immersed in various treatment or coating chemicals. These may include preservatives, sealants, resins, etc. For example, wood scrimber may have resins applied prior to being pressed. The troughs and systems disclosed herein may be used to treat wood. For buoyant products such as wood, a restraining mechanism such as a top conveyor belt, series of rollers, or hold down shoe may be provided above conveyor belt 12, but generally beneath the upper surface of the solution in the trough, to prevent the buoyant materials being processed from floating on top of the chemical solution in the trough.

Although certain illustrative embodiments have been described in detail above, variations and modifications exist within the scope and spirit of this disclosure as described and as defined in the following claims.

The invention claimed is:

1. An apparatus for applying a chemical solution to parts, the apparatus comprising a conveyor belt on which the parts are placed, a trough having a channel through which the conveyor belt is routed, the trough having a pair of sidewalls interconnected by a bottom wall with no end walls, the trough having opposite terminal ends, the conveyor belt extending past both of the opposite terminal ends of the trough, wherein the conveyor belt extends along the sidewalls past the ends of the trough, a liquid delivery system operable to introduce the chemical solution into the trough upwardly through an opening in the bottom wall of the trough with sufficient velocity to jostle the parts and change points of contact between the parts, wherein the chemical solution in the channel of the trough flows toward at least one terminal end of the trough to be discharged downwardly directly from the trough at the at least one terminal end under the influence of gravity, and wherein the parts on the conveyor belt have a tendency to retard movement of the chemical solution toward the at least one terminal end of the trough thereby enhancing accumulation of the chemical solution in the trough and resulting in a greater immersion of the parts in the chemical solution.

2. The apparatus of claim 1, further comprising a reservoir to collect the chemical solution that exits the trough.

3. The apparatus of claim 1, wherein the liquid delivery system includes at least one of pipes, overflowing weirs, and spray nozzles for introducing the chemical solution into the trough.

4. The apparatus of claim 1, wherein the liquid delivery system is operable to introduce the chemical solution into the trough at multiple locations, with independent control over at least one of the discharge velocity and the volume at one or more of the multiple locations.

5. The apparatus of claim 1, wherein the trough has at least one drainage opening spaced from the at least one terminal end of the trough.

6. The apparatus of claim 1, further comprising a sloped pan near the at least one terminal end of the trough and a collection tank, the sloped pan being arranged so that at least some of the chemical solution flows to the collection tank down the sloped pan.

7. The apparatus of claim 1, wherein a bottom wall of the trough is sloped downwardly in one of a first direction and a second direction, the first direction being in a same direction as conveyor belt travel and the second direction being in an opposite direction of conveyor belt travel.

8. The apparatus of claim 1, wherein the liquid delivery system is operable so that at least some of the chemical solution is introduced into the trough with a direction and velocity in one of a first direction and a second direction, the first direction being in a same direction as conveyor belt travel and the second direction being in an opposite direction of conveyor belt travel.

9. The apparatus of claim 1, further comprising an air discharger near the at least one terminal end of the trough to discharge air with a directional component that impedes the flow of the chemical solution out of the trough, thereby increasing the immersion of the parts.

10. The apparatus of claim 1, further comprising a movable gate near the at least one terminal end of the trough, the gate having a closed position to retard the chemical solution from exiting the trough so as to increase the amount of chemical solution retained in the trough near the at least one terminal end, and the gate having an opened position moved away from the closed position.

11. The apparatus of claim 1, further comprising a vibrator coupled to the trough and operable to vibrate the trough to enhance drainage of the chemical solution from the parts as the parts exit from the trough.

12. The apparatus of claim 1, further comprising flights extending upwardly from the conveyor belt, the flights being configured to retard liquid movement out of the trough.

13. The apparatus of claim 12, further comprising seals coupled to the flights, the seals being configured to contact sidewalls of the trough as the flights move through the trough.

14. The apparatus of claim 1, further comprising a restraining mechanism above the conveyor belt and above the parts to prevent the parts from floating on top of the chemical solution in the trough.

* * * * *